US005441036A

United States Patent [19]

Mikalauskas, II et al.

[11] Patent Number: 5,441,036

[45] Date of Patent: Aug. 15, 1995

[54] COOL MULTI-SECTIONED OVEN DOOR FOR A LARGE WINDOW OVEN

[75] Inventors: George A. Mikalauskas, II, Harrison Township, Montgomery County; David N. Corson, Dayton; Gregory J. Paul, Englewood, all of Ohio

[73] Assignee: Whirlpool Corporation, Benton Harbor, Mich.

[21] Appl. No.: 296,589

[22] Filed: Aug. 29, 1994

[51] Int. Cl.[6] ..... F24C 15/04

[52] U.S. Cl. ..... 126/198; 126/194; 126/200

[58] Field of Search ..... 126/190, 198, 200, 193, 126/197, 273 R; 52/616, 304

[56] References Cited

U.S. PATENT DOCUMENTS 3,192,575 7/1965 Rosenau, Jr. .
3,692,015 9/1972 Chase et al. ..... 126/200
3,898,977 8/1975 Draper .
4,043,091 8/1977 Katona .
4,048,978 9/1977 Plumat et al. .
4,102,322 7/1978 Doner ..... 126/198
4,163,444 8/1979 Drouin .
4,206,338 6/1980 Katona .
4,207,863 6/1980 Drouin .
4,253,286 3/1981 Katona .
4,606,324 8/1986 Katona .
4,983,812 1/1991 Worrall et al. .
5,193,520 3/1993 Gostelow et al. ..... 126/198

*Primary Examiner*—James C. Yeung
*Attorney, Agent, or Firm*—Hill, Steadman & Simpson

[57] ABSTRACT

A cool multi-section oven door for use in an oven is disclosed herein. The present invention provides a plurality of pieces of glass, preferably four, each in parallel spaced relation to each other. The spaces between the pieces of glass provide channels for air flow. To provide forced air flow, a fan is positioned under the cooktop area and the air passes through the air gaps between the individual pieces of glass, thus cooling the oven door by allowing the heat to exit at the top of the door. Additionally, heat radiating fins are located on the hinges of the oven door extend into the air flow to provide further cooling.

14 Claims, 2 Drawing Sheets

COOL MULTI-SECTIONED OVEN DOOR FOR A LARGE WINDOW OVEN

BACKGROUND OF THE INVENTION

The present invention relates generally to a oven and more particularly to a cool, multi-sectioned oven door for a large window oven with heat radiating fins on the hinges of the oven door.

Glass panes are often used in the manufacture of inspection windows in the doors of ovens. It is known to use several panes of glass in these windows because of the heat. However, untreated glass panes are not suitable for use in high heat ovens, especially the self-cleaning variety, due to the excessively high heat generated during the self-cleaning process.

Also known in the art are oven windows that use selective reflection, vacuum insulation and forced air cooling to maintain one side of a set of windows cooler than the side that is exposed to high temperature. To this end, a plurality of transparent panes are spaced in a parallel relationship to each other. Air or any other suitable gas or fluid may be forced through the spaces between the transparent panes to provide cooling. Also, the panes may be coated to provide for filtering out infrared radiation.

Thus, it is also known to apply at least one coating of heat resistant material to the glass panes. This coating is a capable of screening off a significant amount of incident infrared radiation generated in the oven. Such a coating may consist of a single layer or it may have multiple layers with similar or varying thicknesses. Also the multiple layers of coatings may be of the same or different coating materials.

Preferred coating types include several metals, i.e. gold, silver, aluminum, copper and palladium since such metals are particularly well-adapted to reflect infrared radiation. Also other coatings include oxides and mixtures of oxides, due to their effectiveness as infrared radiation screens, while at the same time providing good visibility into the oven through the coating itself. For example, these specific oxides include tin oxide and indium oxide which are the most efficient and wear resistant.

U.S. Pat. No. 4,043,091 discloses a self-contained flange mount window unit for use in an oven door. -The window unit has a pair of glass panes held in spaced parallel relationship to each other. The windows are secured to the back panel of the oven door by fasteners. This patent does not disclose using heat radiating hinges and forced air for extra cooling.

U.S. Pat. No. 4,606,324 discloses a multi-piece oven door for use with a self-cleaning oven. The reference discloses a multi-piece glass oven door with air channels between the pieces of glass. However, this patent does not provide using forced air through the air channels nor does it provide heat-radiating tinned hinges.

U.S. Pat. No. 4,253,286 discloses a self-contained window unit adapted to be for use in an oven door. Brackets and spacers are used to hold the pieces of glass in spaced parallel relationship to each other: The patent discloses a window unit having four pieces of glass. However, this patent does not disclose using selected forced air flow with heat radiating hinge fins.

U.S. Pat. No. 4,206,338 discloses a self-contained three pane window unit which is equipped with a microwave shield. It is thus particularly suited for use in a microwave oven. However, this patent does not disclose using four pieces of glass with selected forced air flow and heat radiating hinge fins.

U.S. Pat. No. 4,207,863 discloses a window door for covering the oven cavity of a pyrolytic range having a high temperature self-cleaning cycle. However, this patent does not disclose using four pieces of glass with selected forced air flow and heat radiating hinge fins.

U.S. Pat. No. 3,192,575 discloses a heat insulating window for use in an oven. This reference also discloses a forced flow of cooling fluid between the window panes. However, this patent invention does not disclose the combination of heat radiating hinge fins and forced air cooling with a multi-window oven door.

SUMMARY OF THE INVENTION

It is an object to the present invention to provide an oven door assembly with a plurality of glass panes housed in a window pack sub-assembly and heat radiating oven door hinge fins, wherein the door incorporates forced air cooling of the hinge fins and the glass panes to keep the exterior of the door cool.

The present invention provides and an oven door assembly, having a window pack sub-assembly with a first glass pane, a second glass pane and a third glass pane, the sub-assembly having top openings and bottom openings for allowing air flow therethrough, the glass panes having an infrared reflection coating on at least one side thereof, means for holding the panes in spaced parallel relation to each other thereby providing a first channel between the second glass pane and the third glass pane, a fourth glass pane secured by the window pack to the oven door assembly in spaced parallel relation to the adjacent glass panes in the window pack sub-assembly, thereby providing a second channel between the third glass pane and the fourth glass pane, means for generating a supply of forced air to be channeled through the first and second channels and heat-radiating fins connected to hinges on the oven door so that the fins projecting into the forced air flow for cooling the hinges of the oven door.

In an embodiment, the oven door assembly has insulation held in place by an insulation retainer.

In an embodiment, the oven door assembly has a coating on the surface facing the oven cavity of the first and second glass panes and a coating on the surface facing away from the oven cavity of the third glass pane.

The present invention also provides an oven door assembly for an oven having a front oven door panel, a back oven door panel, a window pack sub-assembly located between the front oven door panel and the back oven door panel and a source of forced air located in the oven to supply the forced air through the window pack sub-assembly.

DETAILED DESCRIPTION OF THE PREFERRED EMBODIMENTS

Figure 1:
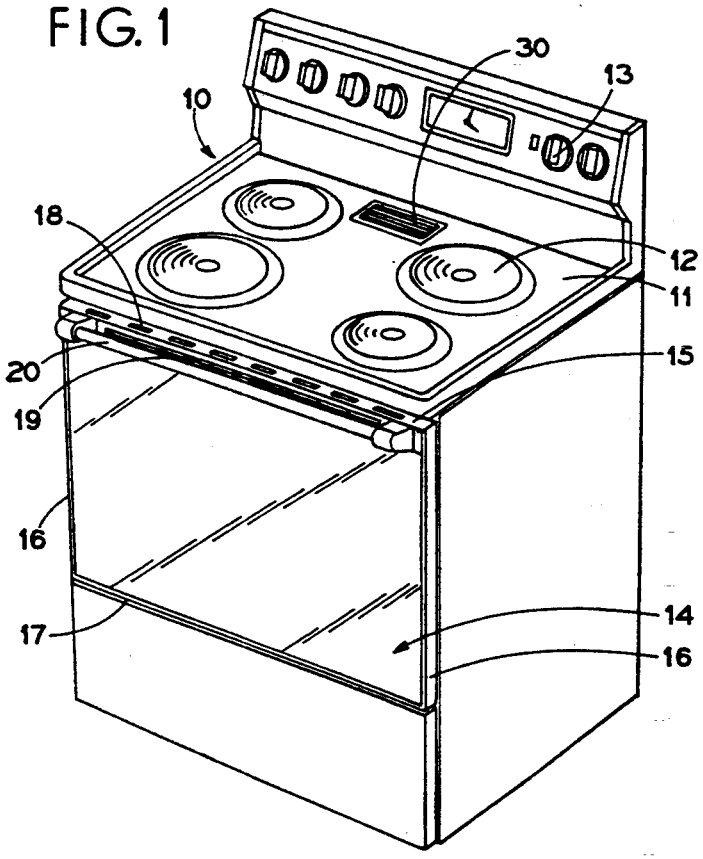
FIG. 1 illustrates a free standing range in which the cool multi-section oven door of the present invention may be utilized.

Referring now to the figures, FIG. 1 illustrates a free standing range 10 in which the oven door of the present invention may be utilized. The range 10 has a cooking surface 11 and a plurality of heating elements 12 thereon. The heating elements 12 are controlled by control knobs 13 on the range 10. A multi-section oven door 14 is illustrated. The door 14 has a top 15 a side 16 and a bottom 17. Also illustrated is a plurality of top air vents 18. Further, a plurality of front vents 19 are also located behind a handle 20 near the top 15 of the oven door 14.

Figure 2:
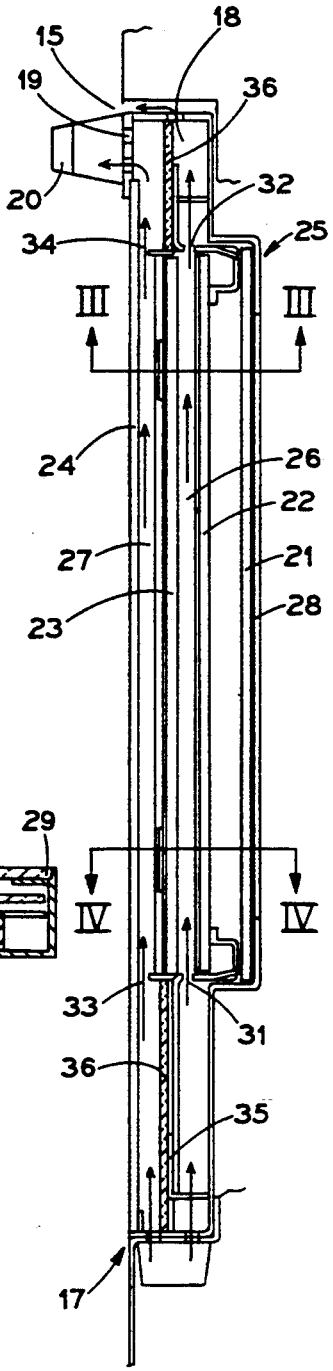
FIG. 2 illustrates a cut away side view of an oven door of the present invention.
Figure 3:
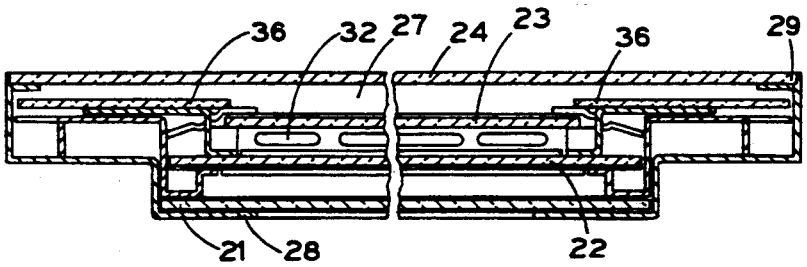
FIG. 3 illustrates a cross sectional view taken along the line III—III of FIG. 2 of the door of the present invention.
Figure 4:
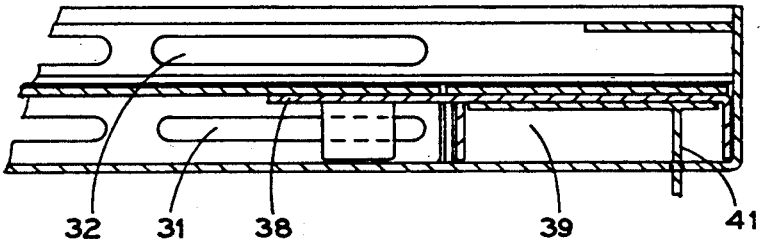
FIG. 4 illustrates a cross sectional view taken along the line IV—IV of FIG. 2 of the door of the present invention.

FIG. 2 illustrates a cross-sectional side view of the present invention. As shown in FIG. 1, FIG. 2 also illustrates the top vents 18, the front vents 19 and the handle 20 near the top 15 of the door 14. The present oven door invention has a plurality of panes of insulating glass. For example, FIG. 2 illustrates a first pane of glass 21, a second pane of glass 22, a third pane of glass 23 and a fourth pane of glass 24. A window pack subassembly 25 is illustrated which provides separation between the first pane of glass 21 and the second pane of glass 22. ]In addition, the other panes of glass are also separated by air gaps. For example, the second pane of glass 22 is separated from the third pane of glass 23 by an air gap 26. Preferably, this air gap has a width of ⅜" in an embodiment. Also, an air gap 27 exists between the third pane of glass 23 and the fourth pane of the glass 24. Additionally, in an embodiment this air gap has a width of approximately ½".

An inner oven door frame 28 and an outer door frame 29 enclose the panes of glass and provides structure to the door. Also illustrated is a fan 30. The fan 30 preferably generates a flow of forced air, and the air inlet is near the bottom 17 of the oven door 14. The generated forced air then flows vertically through an inner lower vent hole 31 and an outer lower vent hole 33. These individual air flows travel through the air gaps 26 and 27, respectively. The portion of forced air flowing through inner lower vent 31 and through air gap 26 exits through an inner upper vent 32 and out top vents 18 near the top 15 of the oven door 14. Similarly, the portion of the forced air flow that enters the oven door through the outer lower vent 33 travels through the air gap 27 and exits out an outer upper vent 34 and proceeds to the exterior of the door via the front vents 19 near the handle 20 of the oven door 14.

Additionally illustrated in FIG. 2 is an insulation retainer 35 which holds a layer of insulation 36 in the door 14. The insulation 36 is located around the periphery of the of glass and within the body of the door 14. The layer of preferably aluminum foil insulation 36 is approximately ⅛" thick.

To provide a door with additional cooling properties, the panes of glass housed in the oven door 14 may be preferably provided with coatings that are reflective to infrared radiation. For example, the first pane of glass 21 is preferably single coated on the surface facing the oven cavity. Also, the second pane of glass 22 is similarly coated on the same corresponding side, i.e. facing the oven cavity. The third pane of glass 23, however, is coated on the side facing away from the oven cavity, toward the exterior of the oven cavity. In addition, in a preferred embodiment the first pane of glass 21 is preferably 3/16" thick; whereas, the second pane of glass 22 and the third pane of glass 23 are preferably ⅛" thick. The above-described coatings and their locations are advantageous in cooling the oven door.

In addition to the cooling effects resulting from coating the glass in the oven door, air is forced through the door 14 by the fan 30 located under the cooktop area to provide added cooling. The air is divided by the insulation retainer 35 and separated into two air flows. The first air flow travels through the inner lower vent 31, proceeds through the air gap 26 and exits at the inner upper vent 32. The second air flow travels through the outer air gap 27 by entering the outer lower vent 33 and exiting the outer upper vent 34 before exhausting through the front vent 19.

Additional cooling effects of the present invention result from the oven door hinge area having a pair of heat dissipating fins 38. The air flow is directed over these fins 38 to provide added cooling of the oven door 14. In prior ranges, there has been limited air flow in this area. Thus, the fins 38 of the present invention provide a heat-radiating means for promoting cooling of the hinge region of the door which reduces the overall oven door temperature.

A hinge channel 39, i.e. where hinges 41 are inserted when the door is in place, have heat radiating fins 38 projecting into the air flow path so that the air can pass over the fins to provide additional cooling. Additionally, air slots are provided in the retainer 35 to accommodate this air flow.

The fins 38 act like a heat sink for the heat being conducted through the hinges from the oven cavity walls. The hinge channel 39 and the fins 38 are approximately 7" high, and the channel 39 is approximately ½" wide. Also, the fin 38 is approximately 2–2½" wide in a preferred embodiment.

In addition the second pane of glass 22 and the third pane of glass 23 are held together by the window pack 25 which also holds the first pane of glass 21 down tight against the outer door frame 29. The width of the retainer 35 is approximately 23 ½" when used in a 27" wide oven. However, the width size of the retainer 35 increases or decreases depending on the size of the door used on a particular range. For example, the width of the retainer 35 increases by three inches for a 30 inch range and decreases by three inches for a 24 inch range.

Figure 5:
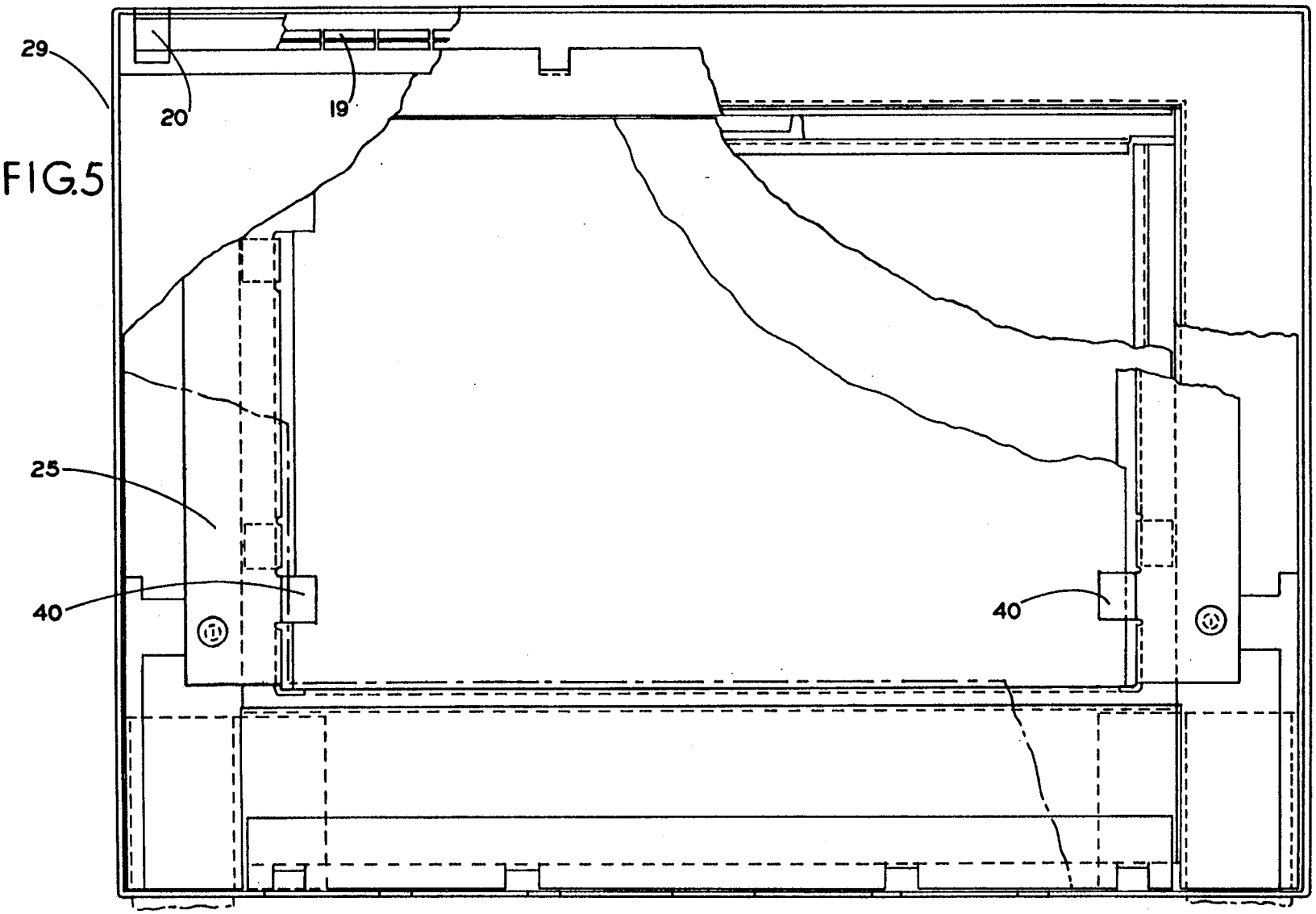
FIG. 5 illustrates the window pack of the present invention in partial cut away view.

Many components of the oven door 14 are also illustrated in FIG. 5, including the front vent 19 near the handle 20. ]FIG. 5 shows a cut away view of the front of the oven door, including the window pack subassembly, i.e. the panes of glass and associated mounting hardware. Tabs 40 are used to hold the panes of glass in spaced parallel relation to each other. The outer door frame 29 contains the component parts of the invention and further provides a uniform exterior surface for the oven door.

As a result of the numerous cooling techniques involved, the present invention thus provides an oven door that has a maximum outside temperature of 49° C. (120° F.) with an 11"×18" oven window. Experimentation has shown the present invention to be extremely effective in cooling the oven door, especially when the oven is in the self-cleaning mode, relative to other doors on commercially-available ovens. This advantageous result is achieved by the above-described unique air flow pattern, the heat-radiating fins at the hinges, the glass spacing and the glass coating directions. Also, the insulation, aluminum foil and insulation position are significant in providing the cool oven door of the present invention. For example, the foil reflects heat back into the oven cavity.

As is apparent from the foregoing specification, the invention is susceptible of embodiments with various alterations and modifications which may differ particularly from those that have been described in the proceeding specification.

It should be understood that we wish to embody within the scope of the patent warranted hereon, all such modifications as reasonably and properly within the scope of our contribution to the art.

The embodiments of the invention in which an exclusive property or privilege is claimed are therefore defined as follows:

1. An oven door assembly, comprising:

a front oven door panel;

a back oven door panel;

a window pack sub-assembly located between said front oven door panel and said back oven door panel, said window pack sub-assembly having a first glass pane, a second glass pane and a third glass pane, said sub-assembly having top openings and bottom openings for allowing air flow therethrough, said glass panes having an infrared reflective coating on at least one side thereof;

means for holding said panes in spaced parallel relation to each other thereby providing a first channel between said second glass pane and said third glass pane;

a fourth glass pane secured by said window pack to said oven door assembly in spaced parallel relation to the adjacent glass panes in said window pack sub-assembly, thereby providing a second channel between said third glass pane and said fourth glass pane;

means for generating a supply of forced air to flow through said first and second channels; and heat-radiating fins connected to hinges on said oven door, said fins projecting into said forced air flow for cooling the hinges of the oven door.

2. An oven door assembly of claim 1, further comprising:

insulation located between said window pack sub-assembly and said front oven door panel; and an insulation retainer for holding said insulation such that said retainer ,divides said forced air flow into two flows, thereby directing a first air flow through said first channel and a second air flow through said second channel in said door.

3. An oven door assembly of claim 1, wherein said coating is on the surface facing the oven cavity of said first and second glass panes and said coating is on the surface facing away from the oven cavity of said third glass pane.

4. An oven door apparatus according to claim 1, wherein said channel between said second glass pane and said third glass pane is approximately $\frac{3}{8}''$.

5. An oven door apparatus according to claim 1, wherein said channel between said third glass pane and said fourth glass pane is approximately $\frac{1}{2}''$.

6. An oven door assembly for an oven, comprising:

a front oven door panel;

a back oven door panel;

a window pack sub-assembly located between said front oven door panel and said back oven door panel; and a source of forced air located in the oven to supply said forced air through said window pack sub-assembly; and hinges on said oven door, said hinges having heat-radiating fins connected to said hinges, said fins projecting into said forced air flow to cool the oven door.

7. An oven door assembly according to claim 6, wherein said window pack sub-assembly comprises a first glass pane, a second glass pane and a third glass pane, said glass panes in parallel spaced relation to one another so that a first channel is provided between said second glass pane and said third glass pane, and wherein said window pack sub-assembly is further defined by providing means for maintaining a fourth glass pane against said front oven door panel so that a second channel is provided between said third glass pane and said fourth glass pane.

8. An oven door assembly according to claim 7, further comprising insulation located between said window pack sub-assembly and said front oven door panel.

9. An oven door assembly according to claim 8, wherein said insulation further comprises an insulation retainer for holding said insulation such that said retainer divides said forced air flow into two flows, thereby directing a first air flow through said first channel and a second air flow through said second channel.

10. An oven door assembly according to claim 9, wherein said insulation further comprises a layer of aluminum foil.

11. An oven door assembly according to claim 6, wherein said glass panes have infrared reflective coatings.

12. An oven door assembly according to claim 11, wherein said coating is applied to the surface facing the oven cavity of said first and second glass panes and to the surface forcing away from the oven cavity of said third glass pane.

13. A method for cooling an oven door, comprising the steps of: providing an oven door assembly having a first glass pane, a second glass pane, a third glass pane and a fourth glass pane with a first channel between said second glass pane and said third glass pane and a second channel between said third glass pane and said fourth glass pane;

generating a supply of forced air; and providing said forced air through said first channel and also through said second channel, said forced air exiting at the top of the oven door, so that said forced air flow also passes over heat radiating fins located in the path of the air and connected to hinges on the oven door.

14. A method according to claim 13, wherein said step of providing said forced air through said first and second channels is further defined by separating said forced air into two separate air flows at the bottom of the oven door so that a first air flow exits at the top of the door and a second air flow exits at the front of the door.

* * * * *